United States Patent [19]

Gottlieb et al.

[11] Patent Number: 4,830,252

[45] **Date of Patent: * May 16, 1989**

[54] HAMMER-ACTIVATED, POWDER-ACTUATED DRIVE TOOL

[75] Inventors: Alfred Gottlieb, Crete, Ill.; Joseph B. Wirtes, Merrillville, Ind.

[73] Assignee: Continental/Midland, Inc., Park Forest, Ill.

[ * ] Notice: The portion of the term of this patent subsequent to Apr. 16, 2005 has been disclaimed.

[21] Appl. No.: 889,953

[22] Filed: Jul. 23, 1986

[51] Int. Cl.[4] ..... B25C 1/14

[52] U.S. Cl. ..... 227/8; 227/10

[58] Field of Search ..... 227/8, 9, 10, 11

[56] References Cited

U.S. PATENT DOCUMENTS

| | | | |
|---|---|---|---|
| 3,497,125 | 2/1970 | O'Brien | 227/10 |
| 3,688,964 | 9/1972 | De Caro | 227/10 |
| 4,025,029 | 5/1977 | Kotas et al. . | |
| 4,252,259 | 2/1981 | Brosius . | |
| 4,492,329 | 1/1985 | Benson et al. | 227/10 |
| 4,493,376 | 1/1985 | Kopf | 227/9 X |
| 4,789,087 | 2/1980 | Combette et al. | 227/10 |

*Primary Examiner*—Paul A. Bell

*Attorney, Agent, or Firm*—Trexler, Bushnell, Giangiorgi & Blackstone, Ltd.

[57] ABSTRACT

The invention concerns improvements in a hammer-activated, powder-actuated drive tool comprising an elongated tubular housing, a tubular piston guide telescopically received extending from the front end of the housing, a piston telescopically movable within the piston guide, a chamber secured to the rear end of the piston guide for mounting a power load therein, and an activating assembly mounted on the tubular housing rearwardly of the chamber and comprising an elongate member slidably mounted relative to the housing and having a rear end extending outwardly of the housing at the rear end thereof and a forward end extending within the housing for contact with a power load mounted within the chamber. One improvement comprises providing the tubular housing with an internal bushing for slidably mounting the elongate activating member formed as a one-piece integrally molded member which experiences substantially no mechanical loading due to the activation of the power load. A further improvement comprises the provision of a retaining member for retaining a power load within the chamber without regard for the orientation of the tool, when the piston guide is in a retracted position. Yet a further improvement comprises a combined piston guide frictional engagement and retaining and piston resetting means mounted to the tubular housing for frictional engagement and retaining engagement with the piston guide and for engagement with the piston for effecting resetting motion thereof relative to the piston guide.

17 Claims, 2 Drawing Sheets

HAMMER-ACTIVATED, POWDER-ACTUATED DRIVE TOOL

BACKGROUND OF THE INVENTION

This invention relates to powder-actuated fastener drive tools, and more particularly to a hammer-activated, powder-actuated drive tool for driving a fastener by means of an explosion of a cartridge or "power load".

More particularly, the present invention is directed to improvements in a tool of the foregoing type and more particularly, a low velocity type of tool. A low velocity type tool includes a piston which is driven by the explosive force of the power load, and drives the fastener into a workpiece. A so-called high velocity tool does not include such a piston, but rather the fastener is driven directly by the explosive force of the power load.

One such low velocity tool is shown and described in U.S. Pat. No. 4,025,029 dated May 24, 1977, to John A. Kotas and Eugene J Haupt. That tool has been further improved by the addition of an external safety spring member which biases the relatively telescoping parts thereof apart somewhat. This biasing is such as to preclude contact of the power load by the activating pin or bolt mechanism until the tool is physically pressed against a workpiece surface so as to telescopically collapse the parts thereof and overcome the safety spring biasing force.

At least one tool is also known, for example as shown in U.S. Pat. No. 4,252,259, Brosius, issued Feb. 24, 1981, which utilizes an internally mounted safety spring to achieve the same end. However, in both of these arrangements, the norma biasing force of the safety spring also leaves an open interior space within the tool directly behind the power load receiving chamber. The power load may readily fall by gravity into this open space in the event the forward end of the tool is rotated above a horizontal position relative to the rear end thereof. This renders the tool unusable, whereupon the tool must be reopened to reinsert the power load in the chamber. This makes installation of fasteners in overhead panels or workpieces, or indeed in any workpiece which would require tilting of the tool front end beyond a horizontal plane, impossible. Advantageously, the present invention provides additional novel power load retaining means for preventing such dislodgement of the power load prior to activation thereof, while maintaining the desired action of the safety spring.

As an additional matter, the prior art tools have generally included a handgrip portion separately formed, usually by molding, from a suitable plastics material. This handgrip portion is then press fitted or otherwise non-removably engaged with one or more structural housing or other parts. These include structural members for mounting the activating pin or bolt and one or more biasing springs, including the above-mentioned internal safety spring, and an elongate tubular piston guide in which a fastener-engaging piston is slidably mounted. Such additional structural members have generally also included a retaining bushing for slidably mounting the activating pin or bolt as well as abutting one end of a biasing spring for normally biasing the bolt away from the fully advanced or power load-activating position thereof. A second bushing or retaining member is often provided for retaining the above-mentioned safety spring in the desired position in the housing. An additional, external tubular housing member is also provided.

This latter housing member has also often been provided with an enlarged end portion having through apertures for receiving a piston guide-retaining and piston-resetting pin member inserted therethrough. This pin member generally defines the forwardmost, or fully telescopically extended positions of the piston guide and fastener-engaging piston respectively relative to the housing. An additional friction member is also often included for providing some slight frictional engagement between the tubular housing and the piston guide. Heretofore, all of the foregoing parts have been separately provided, generally being formed of metal materials by suitable forging and/or machining procedures, and then assembled.

However, we have found that many of the foregoing parts are essentially non-loadbearing parts with respect to the load and forces experienced upon activation of the power load. Accordingly, the present invention advantageously provides a one-piece integrally molded hand grip and housing member of a suitable plastics material. This one-piece member is so formed and configured as to perform the functions of many of the foregoing, previously separately provided parts, thus realizing a great savings in expense of the manufacture and assembly of the tool of the invention.

OBJECTS OF THE INVENTION

Accordingly, it is a general object of the invention to provide a novel and improved low-velocity, hammer-activated, powder-actuated drive tool.

A more specific object is to provide a drive tool in accordance with the foregoing object which provides a safety spring feature for normally holding a power load-activating pin out of engagement with the power load, while nonetheless providing means for positively retaining the power load in its chamber.

A further related object is to provide a drive tool in accordance with the first-stated object, wherein a plurality of parts heretofore separately provided and assembled are advantageously provided as a one-piece integrally molded member.

BRIEF DESCRIPTION OF THE DRAWINGS

The features of the present invention which are believed to be novel are set forth with particularity in the appended claims. The organization and manner of operation of the invention, together with further objects and advantages thereof, may best be understood by reference to the following description taken in connection with the accompanying drawings in the several figures of which like reference numerals identify like elements, and in which:

DETAILED DESCRIPTION OF THE ILLUSTRATED EMBODIMENT

Figures 1, 2, 3, 4, 5:
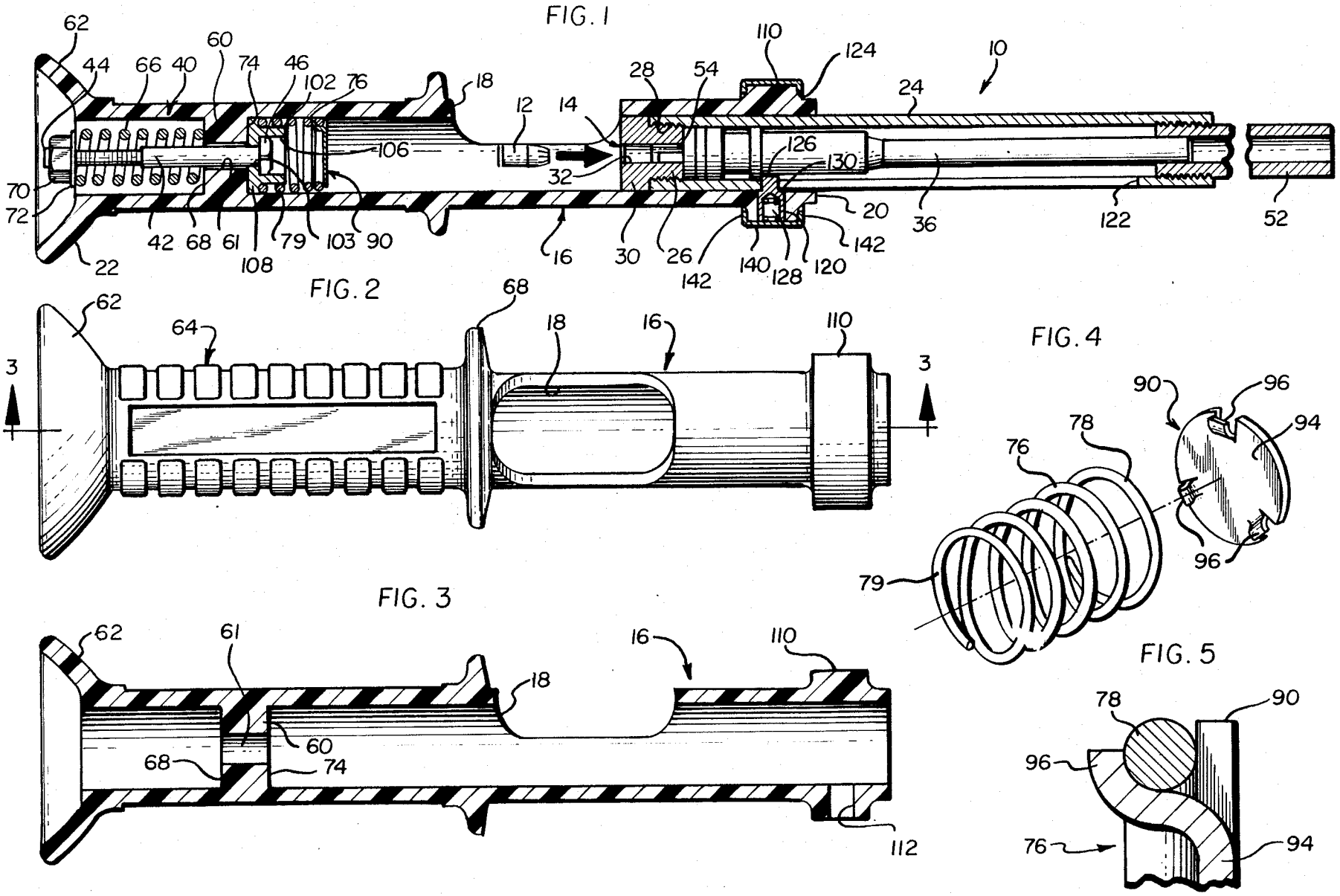
FIG. 1 is an axial sectional view, partially broken away, showing an improved drive tool in accordance with the invention in an extended or open position.
FIG. 2 is a side elevation of a novel, one-piece molded portion of the drive tool of the invention.
FIG. 3 is a sectional view taken generally in the plane of the line 3—3 of FIG. 2.
FIG. 4 is an enlarged perspective view illustrating details of a safety spring and related power load retaining member in accordance with one aspect of the invention.
FIG. 5 is an enlarged partial sectional view illustrating the safety spring and retaining member in further detail.

Referring now to the drawings, and initially to FIG. 1, a hammer-activated, powder-actuated drive tool of the low velocity type is designated generally by the reference numeral 10. In FIG. 1, the tool 10 is illustrated in an extended or open position, suitable for receiving a power load or cartridge 12 within a chamber or mounting means 14 provided interiorly of the tool 10 therefor. Conversely, as will be more fully described later herein, following installation of a fastener, the tool 10 is also manually reset to the position indicated in FIG. 1 to eject a spent power load therefrom. In this regard, a generally tubular elongate housing member or portion 16 of the tool is provided with a through, lateral side opening 18 of sufficient size to permit the described loading of power load 12 and ejection of a spent power load therethrough.

This housing member 16 has a front end 20 and rear end 22, both of which are generally open. The open front end 20 receives a tubular, elongate piston guide 24 generally telescopically mounted therein and extending outwardly therefrom. The piston guide 24 is continuously slidably movable within the housing 16 between a fully extended position as illustrated in FIG. 1 and a retracted position as illustrated in FIGS. 7 and 8, which will be more fully described hereinbelow.

The chamber 14 is preferably secured to the rear end of the piston guide 24. In this regard, reference herein to portions such as front and rear are to be understood as being with respect to the front and rear ends 20, 22 of the housing 16 described above. In the illustrated embodiment, the chamber 14 is provided with a reduced diameter externally threaded portion 26 for threadably engaging a complimentary internal thread 28 on an inner rear surface of piston guide 24. An enlarged body portion 30 of the chamber 14 defines a through bore or chamber 32 of complementary form for receiving power load 12 therewithin. This through bore 32 is also configured and aligned for receiving a spent power load ejecting pin or finger member 34 which is disposed at a rearmost end of a piston 36. This piston 36 is slidably mounted in piston guide 24 for telescopic movement therein between a first, retracted position as illustrated in FIG. 1, and a second, extended position as illustrated for example in FIG. 8.

The rear end 22 of the housing 16 mounts an activating means or assembly designated generally by the reference numeral 40. This activating means or assembly 40 comprises an elongate, and preferably bolt-like member 42, which is slidably mounted relative to the housing 16 and has a rear end portion 44, which extends outwardly of the housing at the rear end 22 thereof, and a forward end 46 which extends within the housing to activate the power load 12 when the latter is mounted in the chamber 14.

Figures 6, 7, 8:
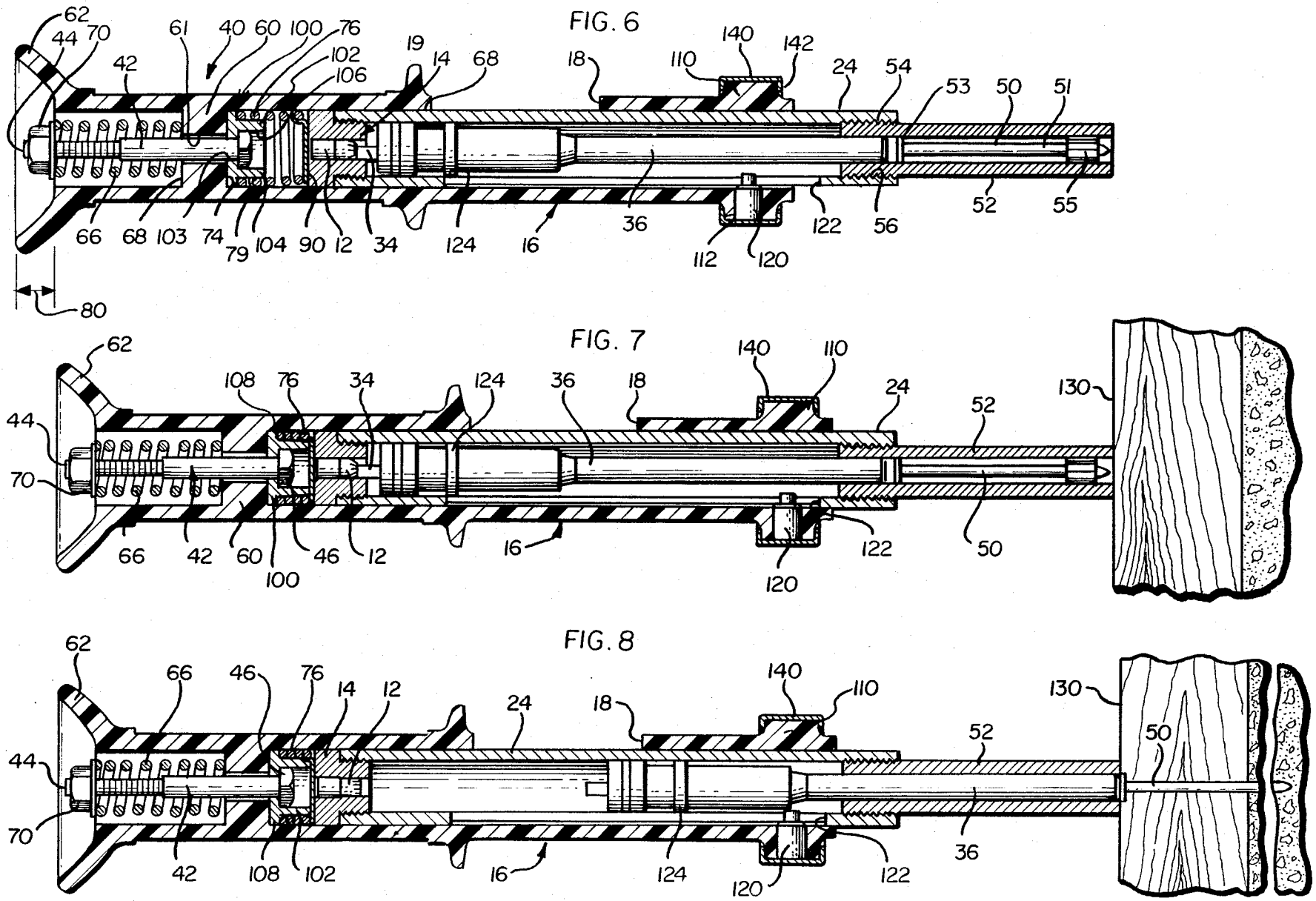
FIG. 6 is an axial sectional view similar to FIG. 1, illustrating the drive tool of the invention with a power load and fastener respectively mounted therein, and partially retracted preparatory to engagement with a workpiece surface.
FIG. 7 is an axial sectional view similrr to FIG. 6, illustrating the tool pressed against a workpiece surface for further retraction thereof to collapse a safety spring member preparatory to driving the fastener.
FIG. 8 is an axial sectional view similar to FIGS. 6 and 7 illustrating the relative position of a fastener-engaging piston member of the tool immediately following hammer activation thereof for fully advancing the fastener relative to the workpiece.

Referring also now briefly to FIG. 6, it will be seen that upon loading of power load 12 relative to chamber 14, the piston guide 24 is telescopically, slidably actuated rearwardly relative to housing 16 to the position illustrated in FIG. 6. In this position, a fastener 50 may be installed in a fastener-receiving tubular extension portion 52 which extends forwardly of the piston guide 24. In this regard, this fastener-receiving tube or extension 52 is preferably externally threaded at its rear end as indicated at reference numeral 54 so as to engage a complementary internal thread 56 at a forward end of the piston guide. The fastener 50 preferably comprises a nail-type fastener having an elongate shaft 51 and an enlarged head 53. In order to initially center and retain the fastener 52 within the fastener-receiving extension or tube 52, an additional frangible plastic centering and retaining member 55, which is generally star-shaped in cross-section, is affixed about a forward end of the shaft 51. It will be understood that this centering and retaining member 55 is frangible and shatters or fractures upon driving of the fastener 50, such that only the shaft or body portion 51 thereof enters the workpiece, as generally illustrated in FIG. 8 for example.

The load-bearing members or portions of the tool 10, that is, those portions which experience loading during activation of the power load 12 and driving of the fastener 50, are preferably formed from suitable strong, reliable metal materials. That is, the piston guide 24, piston 36, fastener-receiving extension 52 and chamber 14 are all formed by suitable forging and/or machining operations from suitable selected metallic materials. In this regard, the bolt-like activating pin or member 42 is also preferably of a metal material, to withstand the forces experienced therein when its outwardly extending end 44 is struck with a hammer or other suitable tool to activate the cartridge 12.

In accordance with an important feature of the invention, the housing 16, which experiences substantially no loading during activation of the power load 12, is advantageously formed as a one-piece integral member from a suitable plastics material. In this regard, the housing also includes an interior, radially inwardly extending bushing wall member for slidably mounting the activating pin 42, this bushing or bushing means also being integrally formed therewith. This bushing means or wall 60 includes a generally circular through central aperture or opening 61 through which the bolt-like activating member or pin 42 slidably extends.

Referring also briefly to FIGS. 2 and 3, it will be seen that the one-piece integrally formed housing 16, in addition to internal bushing 60 includes a flared-out rear end portion 62 which generally surrounds the projecting or protruding rear end 44 of activating pin 42. This surrounding flared-out rear end or skirt portion 62 advantageously discourages any accidental or unintended contact with the projecting end 44 of the activating pin 42, requiring a relatively square and direct blow thereupon with a hammer or like tool to accomplish activation of the power load 12.

Additionally, the one-piece integrally molded housing 16 includes a suitable external hand grip portion 64 thereupon to facilitate gripping of the tool during use. This hand grip portion 64 may, of course, take any of a variety of forms, the form illustrated herein being by way of example only. This hand grip portion may terminate forwardly in an outwardly flared skirt or rim portion 68, terminating rearwardly in the above-mentioned flared-out skirt 62.

The activating mechanism or assembly 40 further includes a preloading or compression spring member 66 surrounding the bolt member and having one end thereof engaged with a rearwardly facing surface 68 of the bushing wall 60. The bolt-like activating member 42 has an enlarged or increased diameter means or member, preferably in the form of a nut 70 engaged with its rear end 44. Preferably, the end 44 is suitably threaded to receive the internally threaded fastener or nut 70 engaged therewith. An additional washer-like abutment member 72 may also be engaged under nut 70 for engaging the rearwardly facing end of preloading or compression spring member 66. This compression or preloading spring member 66 thus normally holds the bolt 42 in the fully retracted position relative to chamber 14, as illustrated in FIGS. 1 and 6 for example.

In accordance with the preferred form of the invention illustrated, an additional internal safety spring member is also mounted in the housing 16 extending forwardly from a forward end 74 of the bushing wall member 60. This safety spring extends forwardly of the forward end or surface 74 of the bushing wall member by an extent considerably greater than the enlarged forward end or head 46 of activating member or bolt 42 when in its retracted position under the influence of the preloading spring 66. This safety spring 76 is also preferably a compression spring, and as best viewed in FIG. 6, normally holds the chamber 14 spaced apart from the bushing wall 60 and also retracted bolt head 46, a sufficient amount to preclude activation of the power load 12 held in the chamber. Accordingly, in order to activate the power load, the tool must first be forcibly pressed against the workpiece in which the fastener is to be inserted, as illustrated in FIG. 7. This will result in sufficient compression of the safety spring 76 to permit activation of the forward end 46 of the activating bolt 42 with the power load 12 when the bolt is struck with a hammer.

In this regard, it will be noted that the normal amount of movement of the bolt 42 in response to striking of the rear end 44 thereof with a hammer or similar tool is limited. That is, the bolt can normally be driven only by a amount equal to the distance of the extended rear end thereof to the forwardmost or innermost end of the flared skirt 62, this distance being indicated generally by arrows 80 in FIG. 6. This distance 80 is only approximately equal to or slightly greater than the amount which the forward end 46 must travel in order to extend completely through the compressed safety spring 76 as shown in FIG. 7 and activation by the rear end of power load 12.

In accordance with an important feature of the invention, an additional retaining means or member 90 is provided for retaining the power load 12 within the chamber 14 without regard for the orientation of the tool 10, when the piston guide is in its retracted position as illustrated in FIGS. 6 through 8. In this regard, and referring also to FIGS. 4 and 5, this retaining means or member 90 is coupled with a forward end of the safety spring 76 and has a solid wall or wall portion 94 alignable with at least a portion of the rearwardly facing end of the power load 12 when it is mounted in the chamber 14 for retaining the same therein when the piston guide is in its retracted position. In the illustrated embodiment, the retaining member is a generally circular, flat, solid disc-like member. However, other configurations may be utilized if desired without departing from the invention, as long as some portion of the retaining means or member 90 in fact overlies some portion of the rear of power load 12 while in the chamber 14.

In the illustrated embodiment, the retaining member 90 is further held or mounted to a forwardmost coil 78 of the spring 76 by a plurality of peripheral, radially projecting gripping tabs 96. These tabs 96 are three in number and substantially symmetrically formed around the periphery of the disc 92. Moreover, the tabs 96, as additionally shown in FIG. 5, are preferably struck out from the material of the retaining member 92 in a generally rearward direction and are struck or otherwise formed with a suitable, generally curved configuration for grippingly engaging the forwardmost coil 78 of the spring therebetween. As also best viewed in FIG. 4, spring 76 will also be seen to preferably comprise a close-ended coil. Also, since in the illustrated embodiment, the struck out tabs 96 extend generally rearwardly of the disc-like retainer 92 so as to grip the coil 78 of spring 76 therebetween, the disc-like solid body 94 is therefore disposed immediately forward of the spring 76.

In the illustrated embodiment, an additional spring retainer and spacer member 100 is also interposed immediately forward of the forwardly facing end 74 of bushing wall 60, generally intermediate this wall 60 and safety spring 76. Spring retainer and spacer member 100 has a forwardly extending, generally reduced diameter portion 102, which defines a tubular interior through opening 103 for receiving a forward portion of the bolt body 42 slidably therethrough, and a generally cylindrical exterior for retaining an interior rearward end portion of the safety spring 76. Preferably, the outer wall surface of portion 102 is generally tapered as indicated at reference numeral 104 to permit extension thereof interiorly of the spring 76 without engaging the same, but rather to permit free extension and retraction thereof, retaining and engaging substantially only a rearwardmost coil 79 thereof. The interior of the member 102 has an enlarged opening 106 of complementary diameter for slidably receiving enlarged bolt head 46 therein, while the opening 103 thereof is relatively reduced to define a stop surface for retaining the same. An enlarged outer diameter portion 108 is also provided for engaging the inner wall of housing 16.

In accordance with a further preferred feature of the invention, the one-piece integrally molded housing member 16 also includes a forwardly located mounting means for mounting tang means so as to frictionally engage and retain the piston guide 24 with respect to the housing, and also for resetting the piston 36 as will be described presently. In the illustrated embodiment, this mounting means includes an increase diameter forward end portion 110, having a generally radially extending through bore 112 formed therein, as best viewed in FIGS. 2 and 3.

In this regard, the preferred form of the tool illustrated includes a combined retaining and reset and friction means for performing the foregoing retaining, frictional engagement and resetting functions with respect to the piston guide 24 and piston 36. Advantageously, these combined resetting, retaining and frictional engagement functions are all performed by a spring-loaded tang member 120 which is mounted within the bore 112 of enlarged diameter forward portion 110 of the housing 16. This tang 120 is configured to extend through an elongate through slot or opening 122 formed in a side surface of the piston guide 24, to thereby not only retain the same relative to the housing, but to guide the same during extension and retraction thereof, generally defining respective fully extended and retracted positions thereof relative to the housing. Moreover, the piston 36 has an enlarged or increased diameter rear end abutment or stop member or surface 124, the tang 120 having a radially inwardly extending portion 126 for engaging the stop or abutment member or surface 124 when the piston is in a generally forwardly extended position relative to the housing as illustrated in FIG. 1 for example. Moreover, the spring loading, preferably provided by a suitable compression spring 128, on the tang 120 is such as to cause some frictional engagement of an enlarged shoulder portion 130 thereof with the surface of the piston guide 24 surrounding elongate slot 122, so as to generally retain the piston guide by friction in any given position to which it may be manually set preparatory to activation of the tool. A generally thin, annular metal band 140 is placed about housing end 110 to retain spring-loaded tang 120 in bore 112. Preferably axially outer ends of band 140 are bent or deformed as indicated at 142 to grip or engage enlarged diameter portion 110.

The resetting of the piston following activation of the tool will be further understood from the following discussion of use of the tool with reference to the successive illustrations of FIGS. 1 and 6 through 8. As previously described, FIG. 1 represents both a starting and an ending position or configuration of the tool, for either receiving a power load preparatory to driving a fastener or, following the driving of a fastener, for ejecting a spent power load from the chamber 14.

Referring initially to the loading of power load 12, following this step as illustrated in FIG. 1, the tool may next be prepared for installation of a fastener by sliding the piston guide 36 to the position illustrated in FIG. 6. Thereupon fastener 50 is installed in extension 52 as previously described. Thereafter, as previously mentioned, the tool must be pressed against a workpiece such as workpiece 130 in FIG. 7 to compress safety spring 76 sufficiently to permit contact of the activating pin or bolt arrangement 42 with the power load 12. Upon such activation, as illustrated in FIG. 8, the piston 36 is driven forwardly to engage and drive the fastener 50 into the workpiece 130.

Following this activation, the tool may be released from its compressed condition against workpiece 130, whereupon the piston is to be returned to the position illustrated in FIG. 1 for ejecting spent power load 12 from the chamber 14. This is accomplished by grasping the piston guide 36 and telescopically sliding it forwardly with respect to the housing 16 to the position illustrated in FIG. 1. It will be noted that upon such forward slidable movement of the piston guide, the piston 36 will tend to move therewith until its enlarged diameter portion 124 engages the tang 120. Thereupon the piston will be retained until the piston guide assumes its full forward position as shown in FIG. 1, which will result in the rearwardly extending ejecting pin or finger 34 of the piston guide extending into the chamber 14 so as to eject the spent cartridge 12 therefrom, through the now fully open lateral side opening 18 of the housing 16.

It will be noted that absent the retaining means or member 90 described above, a substantially open space within safety spring 76 would be present immediately behind the rear end of the power load 12. Hence, the power load could readily fall out of its intended position in chamber 14 and into this open space upon any tilting of the tool forward end vertically above the tool rear end. The tool could not then be activated, but would need to be reopened and the power load reinserted in chamber 14 in order to drive a fastener 50. This would render the driving of fasteners in overhead panels, or indeed in any workpiece or surface which would require tilting of the forward end of the tool relatively upwardly difficult or impossible without the additional retaining means or member 90 described above.

While particular embodiments of the invention have been shown and described in detail, it will be obvious to those skilled in the art that changes and modifications of the present invention, in its various aspects, may be made without departing from the invention in its broader aspects, some of which changes and modifications being matters of routine engineering or design, and others being apparent only after study. As such, the scope of the invention should not be limited by the particular embodiment and specific construction described herein but should be defined by the appended claims and equivalents thereof. Accordingly, the aim in the appended claims is to cover all such changes and modifications as of all within the true spirit and scope of the invention.

The invention is claimed as follows:

1. An improvement in a hammer-activated, powder-actuated drive tubular tool comprising an elongated tubular housing having front and rear ends; a piston guide having a front end and a rear end slidably telescopically received within the housing extending from the front end thereof and continuously slidably movable therein between a retracted position and an extended position; a piston slidably received within said piston guide and telescopically movable therein between a first, retracted position and a second, extended position; means forming a chamber and secured to the rear end of said piston guide for mounting a power load therein, and activating means mounted on said tubular housing rearwardly of the chamber-forming means and comprising an elongate member slidably mounted relative to said housing and having a rear end extending outwardly of said housing at the rear end thereof and a forward end extending within said housing for contact with a power load mounted within the chamber means; wherein the improvement comprises said tubular housing including internal bushing means for slidably mounting said elongate activating member; and wherein said tubular housing and said bushing means therein are formed as a one-piece integrally molded plastic member which experiences substantially no mechanical loading due to the activation of said power load.

2. The improvement according to claim 1 wherein said activating mechanism comprises an elongate, generally cylindrical bolt-like member having an enlarged head at one end thereof, and wherein said bushing means comprises a bushing wall extending inwardly of said housing and having a generally circular through aperture therein for slidably receiving said bolt-like member therethrough; said activating mechanism further comprising a preloading spring member surrounding said bolt member and having one end thereof engaged with a rearwardly facing surface of said inwardly extending bushing wall, said bolt-like member having an increased diameter member engaged with its opposite end for engaging an opposite end of said preloading spring member, whereby said bolt-like member is normally held by said preloading spring member in a fully retracted position relative to said chamber.

3. The improvement according to claim 1 and further comprising a safety spring member mounted internally of said housing extending forwardly from a forward end of said bushing means therein; said safety spring normally holding said chamber spaced apart from said bushing wall by an amount sufficient to preclude contact of said bolt with a power load held therein; and further including retaining means for retaining a power load within said chamber without regard for the orientation of the tool, when the piston guide is in its retracted position.

4. The improvement according to claim 1 wherein said one-piece integrally molded part further defines a hand grip portion on an external surface thereof; and a through opening in a sidewall surface thereof for introducing said power load therethrough for introduction into said chamber means and for removal of a spent power load therefrom.

5. The improvement according to claim 1 wherein said one-piece integrally molded member further includes a forwardly located mounting means for mounting tang means for frictionally engaging and retaining said piston guide and for resetting said piston.

6. The improvement according to claim 5 wherein said forwardly located mounting means comprises a forward portion of increased thickness having formed therein a through aperture for mounting the tang means.

7. The improvement according to claim 1 and further including combined retaining and reset and friction means for respectively frictionally engaging and retaining said piston guide relative to said tubular housing and for resetting said piston to a retracted position relative to said piston guide following installation of a fastener thereby.

8. The improvement according to claim 7 wherein said combined retaining, resetting and engaging means comprises a through opening in a side surface at a forwardly located portion of said tubular housing, an elongate through slot in said piston guide member alignable with said through opening, an enlarged diameter stop portion on said piston and a spring loaded tang member within said housing through opening for engagement with said enlarged diameter stop portion on said piston, for retaining said piston guide within said tubular housing, and for frictionally engaging a surface of said piston guide adjacent said elongate slot therein.

9. The improvement according to claim 7 and further including a generally cylindrical retaining band member engaged about a portion of said tubular housing for overlying and positively retaining said spring loaded tang means therein.

10. An improvement in a hammer-activated, powder-actuated drive tubular tool comprising an elongated tubular housing having front and rear ends; a piston guide having a front end and a rear end slidably telescopically received within the housing extending from the front end thereof and continuously slidably movable therein between a retracted position and an extended position; a piston slidably received within said piston guide and telescopically movable therein between a first, retracted position and a second, extended position; means forming a chamber and secured to the rear end of said piston guide for mounting a power load therein, and activating means mounted on said tubular housing rearwardly of the chamber-forming means and comprising an elongate member slidably mounted relative to said housing and having a rear end extending outwardly of said housing at the rear end thereof and a forward end extending within said housing for contact with a power load mounted within the chamber means; wherein the improvement comprises said tubular housing including internal bushing means for slidably mounting said elongated activating member; and wherein said tubular housing and said bushing means therein are formed as a one-piece integrally molded member which experiences substantially no mechanical loading due to the activation of said power tool, and further, wherein said retaining means comprises a retaining member coupled to a forward end of said safety spring and having a solid wall portion alignable with at least a portion of a rearwardly facing end of a power load mounted in said chamber for retaining the same therein, when the piston guide is in its retracted position.

11. The improvement according to claim 10 wherein said retaining member comprises a generally circular, flat, disc-like member having a plurality of peripheral gripping tabs for engaging a forward end of said safety spring member.

12. The improvement according to claim 11 wherein said gripping tabs are struck out of a peripheral edge part of said disc-like member and extend rearwardly thereof to grip a facing forward coil of said safety spring therebetween.

13. The improvement according to claim 12 wherein said outer wall surface of said spring retainer and spacer member is generally tapered so as to engage substantially only a rearmost coil of said spring member in a press fit thereover and permit free extension and retraction of remaining relatively forwardly located coils of said safety spring member.

14. The improvement according to claim 11 and further including a spring retainer and spacer member interposed intermediate a forwardly facing end of said bushing means and said safety spring member and having a forwardly extending tubular portion defining a tubular interior for receiving a forward portion of said bolt member slidably therethrough and a generally cylindrical outer wall surface for engaging and retaining an interior rearward end portion of said safety spring member.

15. An improvement in a hammer-activated, powder-actuated drive tool comprising an elongate tubular housing having front and rear ends, a tubular piston guide having a front end and a rear end telescopically received within the housing extending from the front end thereof and continuously slidably movable therein between a retracted position and an extended position; a piston slidably received within said piston guide and telescopically movable therein between a first, retracted position and a second, extended position; means forming a chamber and secured to a rear end of said piston guide for mounting a power load therein, and activating means mounted on said tubular housing rearwardly of the chamber-forming means and comprising an elongate member slidably mounted relative to said housing and having a rear end extending outwarldy of said housing at the rear end thereof and a forward end extending within said housing for contact with a power load mounted within chamber means; wherein the improvement comprises retaining means for retaining a power load within said chamber means without regard for the orientation of the tool when the piston guide is in its retracted position, and further comprising an internal bushing for slidably mounting said elongate activating member, and a safety spring member mounted internally of the housing and extending forwardly from said bushing; and wherein said retaining means comprises a retaining member coupled to a forward end of said safety spring and having a solid wall portion alignable with at least a portion of a rearwardly facing end of a power load mounted in said chamber for retaining the same therein when the piston guide is in its retracted position.

16. The improvement according to claim 15 wherein said retaining member comprises a generally flat circular disc-like member having a plurality of peripheral gripping tabs for engaging a forward end of said safety spring member.

17. The improvement according to claim 16 wherein said gripping tabs are struck out of a peripheral edge part of said disc-like member and extend rearwardly thereof to grip a facing forward coil of said safety spring therebetween.

* * * * *